United States Patent [19]

Kirchesch et al.

[11] Patent Number: 4,559,425

[45] Date of Patent: Dec. 17, 1985

[54] COMPRESSED-GAS BREAKER

[75] Inventors: Heinz-Peter Kirchesch, Fislisbach; Wilhelm Nürck, Dielsdorf; Wolfgang Widl, Glattbrugg, all of Switzerland

[73] Assignee: BBC Brown, Boveri & Company, Limited, Baden, Switzerland

[21] Appl. No.: 650,058

[22] Filed: Sep. 13, 1984

[30] Foreign Application Priority Data

Oct. 28, 1983 [CH] Switzerland ..... 5837/83

[51] Int. Cl.[4] ..... H01H 33/12

[52] U.S. Cl. ..... 200/146 R; 200/148 R; 200/147 R

[58] Field of Search ..... 200/146 R, 148 R, 148 A, 200/148 B, 147 R

[56] References Cited

U.S. PATENT DOCUMENTS

| | | | |
|---|---|---|---|
| 4,086,461 | 4/1978 | Gonek | 200/146 R |
| 4,338,500 | 7/1982 | Pham Van et al. | 200/146 R |
| 4,463,230 | 7/1984 | Perrenoud | 200/146 R |

*Primary Examiner*—Robert S. Macon

*Attorney, Agent, or Firm*—Burns, Doane, Swecker & Mathis

[57] ABSTRACT

A compressed-gas breaker having a magnetic coil through which the breaking current flows, has two coaxial contact members which are movable with respect to each other along a central axis and have in each case one arcing contact. The arcing contacts are surrounded by a heating chamber which is joined to the arc volume located between the separated burning contacts during breaking. In this breaker, the breaking capacity is to be improved by a simple means. This is achieved by the fact that between the heating chamber and the arc volume a gas-guiding device is provided which has at least three ducts which are arranged to be distributed azimuthally around the axis. These ducts have sections which open radially with respect to the axis into the arc volume. Such a breaker can be used preferably for the switching of large current of medium-high voltage.

12 Claims, 2 Drawing Figures

COMPRESSED-GAS BREAKER

BACKGROUND OF THE INVENTION

The invention relates to a compressed-gas breaker having two coaxial contact members movable with respect to each other along an axis. Such a breaker is known, for example, from EP-A1-075341. The known breaker has two coaxial contact members which are movable with respect to each other and which have in each case one arcing contact, and a coil through which the breaking current flows and which is electrically conductively connected to an arcing ring. The arcing contacts are surrounded by a heating chamber. The quenching gas contained in this heating chamber is heated up during the breaking process in the high-current phase by the switching arc rotating under the influence of the magnetic field of the coil through which the current flows. Particularly during the switching of small currents, the pressure, generated in this manner, of the quenching gas stored in the heating chamber may not be adequate for an adequate blasting of the switching arc.

OBJECTS AND SUMMARY OF THE INVENTION

The invention has the object of improving the breaking capacity of a generic breaker with simple means.

The breaker according to the invention is essentially characterised by the fact that the heating capacity of the switching arc is utilised extremely effectively for generating quenching gas with high pressure by suitably stabilizing the flow of the quenching gas heated up during a switching process and that the means provided for stabilising the flow of the heated quenching gas can simultaneously be used for conducting, in an optimum manner, the quenching gas flowing into the arc volume for blasting the switching arc.

BRIEF DESCRIPTION OF THE INVENTION

In the text which follows, an illustrative embodiment of the invention is described, for the purpose of more detailed explanation, with the aid of the drawing in which:

FIG. 1 shows a top view of a longitudinal section through a high-voltage circuit breaker which is constructed in accordance with the invention and in which the breaker is shown in the switched-on condition in the left half of the Figure and in the switched-off position in the right half of the Figure, and FIG. 2 shows a top view of a section along II—II through the breaker according to FIG. 1.

DETAILED DESCRIPTION OF THE PREFERRED EMBODIMENT

Figure 1:
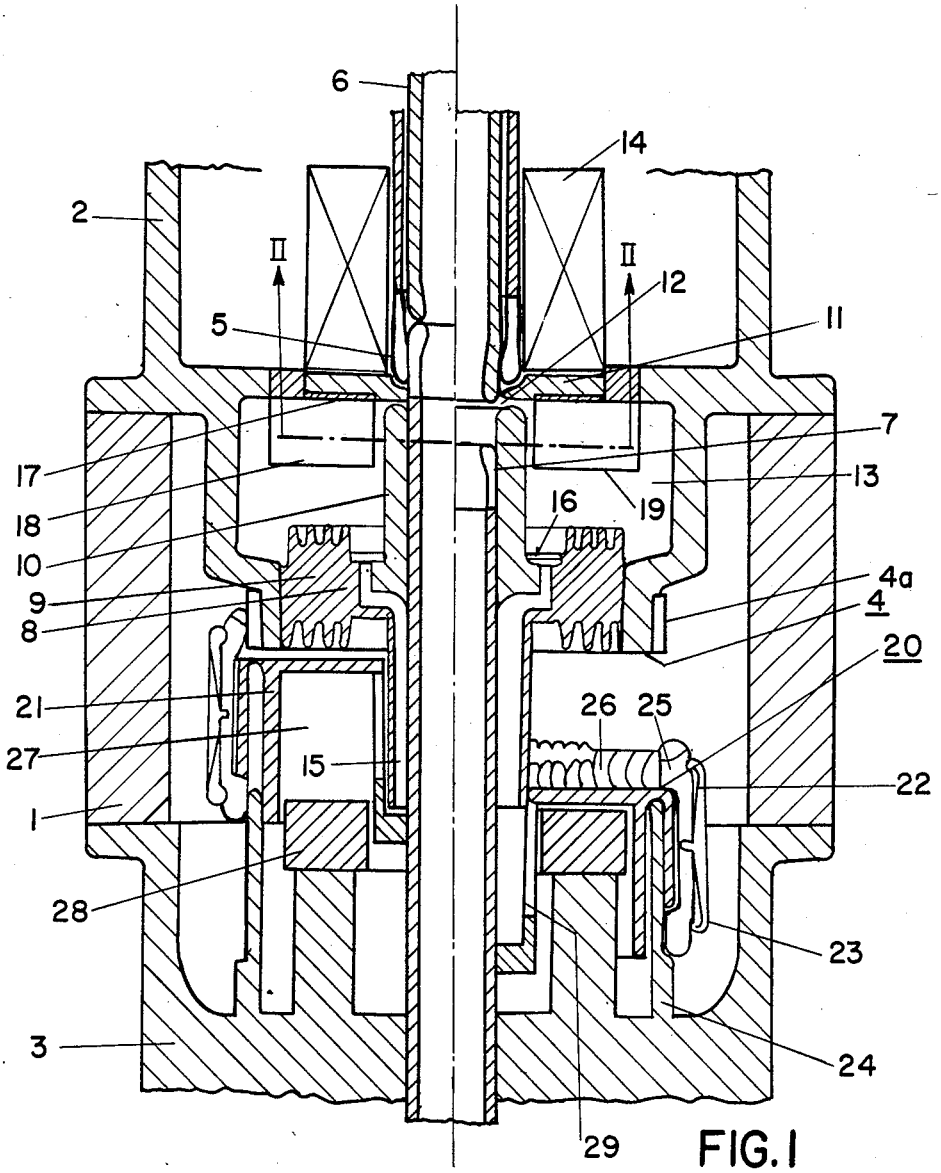

In FIG. 1, 1 designates a hollow-cylindrical insulating-material body which is positioned between flanges of two hollow current connectors 2 and 3 in a gastight manner.

The current connector 2 carries a stationary contact member with an annular rated-current contact 4 and with a hollow arcing contact 5 in the interior of which a nozzle-shaped insulating-material part 6 is arranged. In the switched-on position (left half of the Figure), this part 6 is pushed by a movable, nozzle-shaped arcing contact 7 against the force of a spring (not shown) into the interior of the arcing contact 5.

In the interior of the current connector 2, an insulating-material body 8 is mounted. This insulating-material body 8 is provided with an insulator 9, provided with annular ribs, and an adjoining tubular insulating-material part 10. In the switched-off condition, the insulator produces a leakage-current proof insulating space between the rated-current contact 4 and the arcing contact 7. The insulating-material part 10 is penetrated by the arcing contact 7 and, at its end facing the stationary contact member, delimits, together with an arcing ring 11 mounted in an insulating manner at the current connector 2, an annular gap 12. The annular gap 12 joins a heating volume 13 enclosed by the current connector 2, the insulating-material body 8 and the arcing ring 11 to an arc volume located between the open burning contacts 5 and 7 during a switching process. The arcing ring 11 consists of an arc-resistant material and, like the arcing contact 5, is connected to one connection of a coil 14, the other connection of which is electrically conductively connected to the current connector 2. An annular duct 15 extending along the arcing contact 7 and against which the heating chamber 13 can be blocked off via a back-pressure valve 16 opens into the heating chamber 13.

The filter part of the arcing ring 11 is covered by an insulating-material ring 17. Attached to the insulating-material ring 17 are radially extending guide vanes 18, which reach into the heating chamber 13 directly up to the opening of the annular gap 12, made of an insulating material which emits quenching gas at increased temperatures, such as, for example, polytetrafluoroethylene. These guide vanes are part of a gas guiding device provided between the heating volume 13 and the arc volume.

Figure 2:
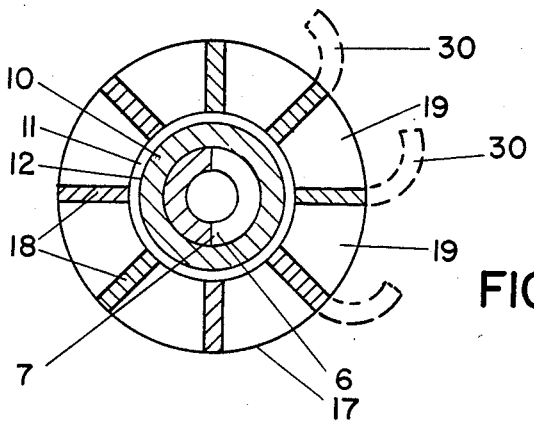

As can be seen from FIG. 2, the guide vanes 18 are mounted, spaced apart from each other, on the insulating-material ring 17 and delimit ducts 19. The ducts 19 are arranged to be azimuthally distributed around a central axis and open radially with respect to the axis into the annular gap 12 delimited by the arcing ring 11 and the insulating-material part 10. They thus establish a part of the connection between the heating chamber 13 and the arc volume.

The current connector 3 carries a contact member which is attached coaxially to the stationary contact member and is movable along the central axis and has a movable rated-current contact 20 and the movable arcing contact 7. The movable rated-current contact 20 contains contact fingers which are supported parallel to one another on the outer surface of a support plate 21 of electrically conductive material, which is rigidly joined to the movable arcing contact 7. The contact fingers are supported in an elastic manner in a hollow-cylindrical cage 23 by means of leaf springs 22, which are bent in the shape of a harp. The contact fingers have at each of their ends inwardly directed contact surfaces. One contact surface is supported, both in the switched-on and in the switched-off condition, on the outer surface of an annular extension 24 of the current connector 3 whereas the other contact surface bears against the stationary rated-current contact 4 only in the switched-on condition. A part 25 of the contact fingers projects past the remaining contact fingers 26 at the ends facing the stationary contact member and is constructed to be arc resistant at the projecting ends. In the support part 21, an annular compression space 27 is recessed which is closed by an annular piston 28 rigidly attached to the current connector 3. On the inner surface of the support part 21, slots 29 are provided which join the compression space 27 to the heating volume 13 via the annular duct 15.

The interior of the housing delimited by the insulating-material body 1 and the current-connectors 2 and 3 is filled with an insulating gas such as, for example, sulfur-hexafluoride under pressure.

The high-voltage circuit breaker according to the invention operates as follows:

In the switched-on position (left half of FIG. 1), the movable arcing contact 7 passes through the arcing ring 11 and is introduced into the stationary arcing contact 5. The face of the movable arcing contact 7 bears against the face of the insulating-material part 6 which closes the interior of the arcing contacts 5 and 7 off with respect to the annular gap 12 and the ducts 19. The contact surfaces, facing the stationary contact member, of all contact fingers 25 and 26 of the movable rated-current contact 20 bear against the stationary rated-current contact 4. The predominant part of the current now flows from current connector 2 via the rated-current contact 4, the rated-current contact 20 and the extension 24 to the current connector 3.

During breaking, the arcing contact 7, provided with a drive, not shown, and thus also the rated-current contact 20, which is frictionally connected to the arcing contact 7 via the support part 21, is moved downwards. During this movement, initially the contact fingers 26 are disengaged from the rated-current contact 4. Since arc-resistant contact parts 4*a* are attached to the rated-current contact 4 in such a manner that they act in conjunction with the contact fingers 25 in the switched-on position, the current now flows via the current connector 2, the arc-resistant contact parts 4*a*, the contact fingers 25 and the extension 24 to the current supply 3.

As soon as 4*a* and 25 are separated, the current is commutated into a parallel current path and now flows from current connector 2 via the coil 14, the arcing contact 5, the arcing contact 7, the support part 21, the contact fingers 25 and 26 and the extension 24 to the current connector 3. An arc which may occur during the commutating process when switching large currents is drawn between the contact parts 4*a* and contact fingers 25. Since these parts are constructed to be arc resistant, damaging of the rated-current contacts 4 and 20 is prevented.

After commutation of the current, the two arcing contacts 5 and 7 separate and an arc, not shown, is drawn between these two contacts, the root of which arc, located at the arcing contact 5, commutates in the course of the further breaking process, to the arcing ring 11 under the action of the insulating-material part 6 which moves downwards. The current now flows via the current connector 2, the coil 14, the arcing ring 11, the arc (not shown), the arcing contact 7, the support part 21, the contact fingers 25 and 26 and the extension 24 to the current connector 3. Under the action of the magnetic field of the coil 14, through which current now flows, the arc begins to rotate around the central axis and to heat up the insulating gas located in the arc volume. In the high-current phase, the arc rotates at high velocity around the central axis and greatly heats the quenching gas located in the arc volume. Under the action of centrifugal forces, the heated quenching gas is transported outwards and a pressure reduction is caused at the nozzle openings of the arcing contact 7 and the insulating-material part 6 and, in contrast, a pressure increase is caused at the periphery of the mass of gas rotating in the quenching-gas volume. The high-pressure heated quenching gas flows through the annular gap 12 and the ducts 19 into the heating chamber 13 where it mixes with the cold quenching gas stored there.

In this arrangement, the guide vanes 18 have the effect, among others, of limiting the rotation of the quenching gas, heated by the arc, to the arc volume. The rotational impulse of the rotating quenching gas flowing off from the periphery of the arc volume is received into the ducts 19 of the guide vanes 18 at the mouth of the annular gap 12. This prevents the cold quenching gas located in the heating chamber 13 from being set in rotation by heated quenching gas flowing in. In addition, cold quenching gas flowing in the opposite direction is prevented from flowing from the heating chamber 13 into the arc volume. This makes it possible to increase considerably the rotational velocity and thus the pressure at the periphery of the arc quenching zone. The heating capacity is correspondingly increased in the heating chamber 13 and decreased in the exhaust. This considerably improves the breaking capacity, particularly in the case of small current, with respect to comparable breakers without guide vanes. The reduced heating power in the exhaust makes it possible to keep the exhaust volume smaller.

The heated quenching gas essentially flows in a radial direction through the ducts 19 into the heating chamber 13 where it is mixed with the already existing cool quenching gas and stored. Mixing of the heated quenching gas with the cool quenching gas can be promoted by the ducts 19 having sections which open in a tangential direction into the heating volume 13. This can be achieved, for example, by the fact that the guide vanes, as shown dashed in the left half of FIG. 2, have tangentially curved end parts 30.

Shortly before the zero transition of the current, when the heating effect of the switching arc has considerably abated and the pressure of the quenching gas stored in the heating chamber 13 exceeds the pressure of the quenching gas in the arc volume, the compressed quenching gas emerges via the ducts 19 and the annular gap 12 from the heating volume 13 and blasts the weakening arc to an increased extent. The important factor in this connection is that the sections of the ducts 19 opening into the annular gap 12 are radial since this achieves a particularly effective radial blasting of the arc.

The ducts 19 can also be formed by openings in the wall of a hollow cylinder of insulating material. This has the advantage that the hollow cylinder is simultaneously the inner wall of the heating volume 13 and replaces the insulating-material part 10.

Tests have shown that just three ducts which are azimuthally uniformly distributed produce an improvement in the blasting of the switching arc of comparable breakers without such ducts and that an especially effective blasting of the switching arc occurs if more than six ducts are present.

When switching extremely small currents, the power of the arc may not be adequate for generating a quenching-gas pressure in the heating chamber 13 which is adequate for quenching the switching arc. However, adequate blasting of the switching arc drawn with small currents is made possible by means of quenching gas which is condensed in the compression space 27 during a switching process and is blown into the quenching zone via the slots 29, the annular duct 15, the back-pressure valve 16 the heating volume 13 the ducts 19 and the annular duct 12. The advantageous effect of such additional blasting is available in accordance with the arrangement of the heating chamber 13 without the disadvantage of additional space requirements. Corresponding to the heating chamber 13 arranged in the current connector 2, neither is any additional space required for the compression space 27 of the additional blasting since this compression space 27 can be comfortably accommodated in the already existing support part.

We claim:

1. A compressed-air breaker comprising two coaxial contact members which are movable with respect to each other along one axis, each contact member being provided with an arcing contact, said arcing contacts movable to a breaking position of separation to form an arcing volume therebetween, a coil, through which breaking current flows, an arcing ring electrically conductively connected to said coil, a heating chamber surrounding said arcing contacts for storing quenching gas, said heating chamber being in gas communication with said arcing volume, a gas guiding device coaxial with said contact members disposed in said heating chamber, said gas guiding device having at least three ducts distributed azimuthally around said one axis and opening radially about said axis to provide communication between said heating chamber and arcing volume.

2. A compressed-gas breaker according to claim 1, wherein the gas guiding device includes guide vanes which delimit the ducts and which are radially directed with respect to the axis and are spaced apart from each other.

3. A compressed-gas breaker according to claim 2, wherein the guide vanes contain an insulating material which emits quenching gas when heated.

4. A compressed-gas breaker according to claim 2, wherein an annular gap is provided between the heating chamber and the arc volume, and the guide vanes have an inner edge directly at the opening of the annular gap into the heating chamber.

5. A compressed-gas breaker according to claim 1, wherein the gas guiding device is in the shape of a hollow walled cylinder through which the ducts pass.

6. A compressed-gas breaker according to claim 1, wherein the ducts are provided with a curved member to impart a tangential flow of gas into the heating chamber.

7. A compressed-gas breaker according to claim 1, wherein one of the contact members is movable and includes an electrically conductive support part and a rated-current contact, the support part having a gas-filled hollow interior in communication with said heating chamber, and means for compressing the gas in said hollow chamber when said contact is moved to a breaker position.

8. A compressed-gas breaker according to claim 3, wherein an annular gap is provided between the heating chamber and the arc volume, and the guide vanes have an inner edge directly at the opening of the annular gap into the heating chamber.

9. A compressed-gas breaker according to claim 2, wherein the guide vanes are provided with a curved member to impart a tangential flow of gas into the heating chamber.

10. A compressed-gas breaker according to claim 3, wherein the guide vanes are provided with a curved member to impart a tangential flow of gas into the heating chamber.

11. A compressed-gas breaker according to claim 4, wherein the guide vanes are provided with a curved member to impart a tangential flow of gas into the heating chamber.

12. A compressed-gas breaker according to claim 5, wherein the guide vanes are provided with a curved member to impart a tangential flow of gas into the heating chamber.

* * * * *